US008382977B1

(12) United States Patent
Jones

(10) Patent No.: US 8,382,977 B1
(45) Date of Patent: Feb. 26, 2013

(54) BUILT IN POOL SKIMMER ENHANCEMENT SYSTEM

(76) Inventor: Ryan C. Jones, Dunedin, FL (US)

( * ) Notice: Subject to any disclaimer, the term of this patent is extended or adjusted under 35 U.S.C. 154(b) by 406 days.

(21) Appl. No.: 12/804,814

(22) Filed: Jul. 29, 2010

Related U.S. Application Data

(63) Continuation-in-part of application No. 12/586,511, filed on Sep. 23, 2009, now Pat. No. 8,202,416.

(51) Int. Cl.
*E04H 4/12* (2006.01)

(52) U.S. Cl. ..... 210/167.18; 4/507

(58) Field of Classification Search ..... 210/167.1, 210/167.18; 4/507
See application file for complete search history.

(56) References Cited

U.S. PATENT DOCUMENTS

| | | | | |
|---|---|---|---|---|
| 4,818,389 | A * | 4/1989 | Tobias et al. | 210/167.12 |
| 4,904,379 | A * | 2/1990 | Ward | 210/167.18 |
| 5,510,020 | A * | 4/1996 | Gronlund | 210/167.18 |
| 2004/0238425 | A1 * | 12/2004 | Hodak | 210/169 |
| 2005/0242014 | A1 * | 11/2005 | Schneider | 210/169 |
| 2009/0120856 | A1 * | 5/2009 | Meagher | 210/167.1 |

* cited by examiner

*Primary Examiner* — Fred Prince

(57) ABSTRACT

A pool has an opening formed with upper and lower surfaces and first and second side surfaces. A chamber located interiorly of the opening has a cylindrical well with a vertical axis. A first diverter plate has an exterior edge adjacent to the first side surface and an interior edge between the opening and the well. The first diverter plate is arcuate with a vertical axis of rotation adjacent to the first side surface. A second diverter plate has primary and secondary sections. The primary section has an exterior edge adjacent to the second side surface and an interior edge between the opening and the well and is arcuate with a vertical axis of rotation adjacent to the second side surface. The secondary section is located adjacent the primary section with a vertical axis of rotation essentially co-extensive with the axis of the well.

5 Claims, 6 Drawing Sheets

FIG 1
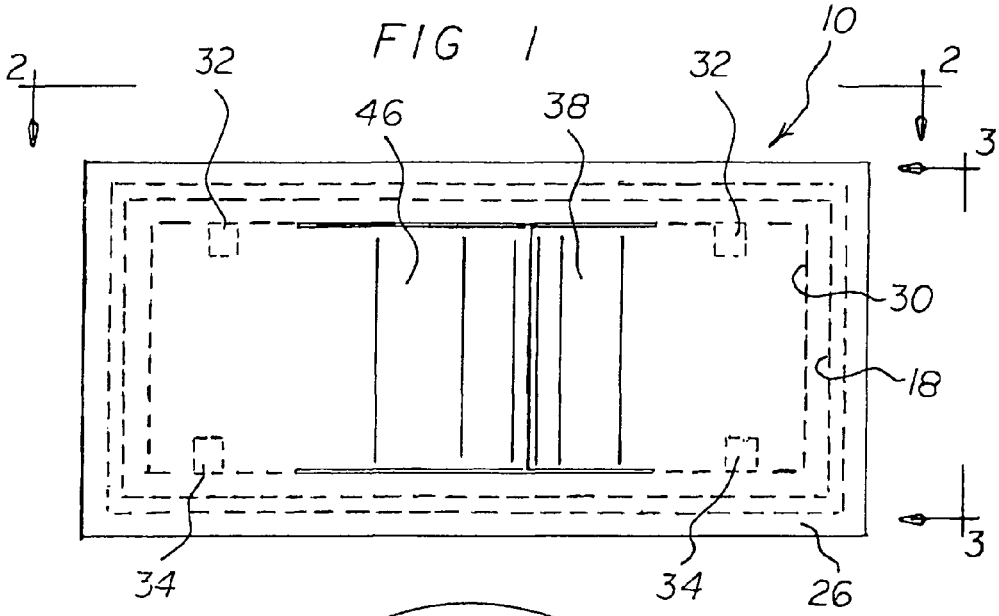
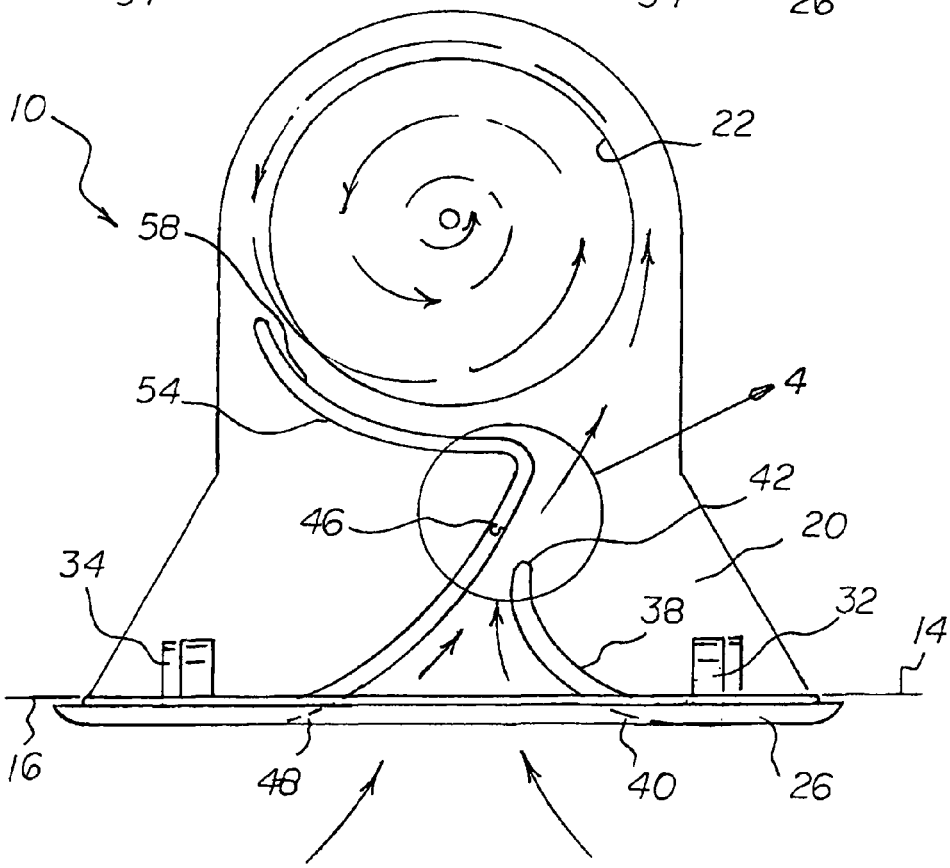
FIG 2

FIG 3
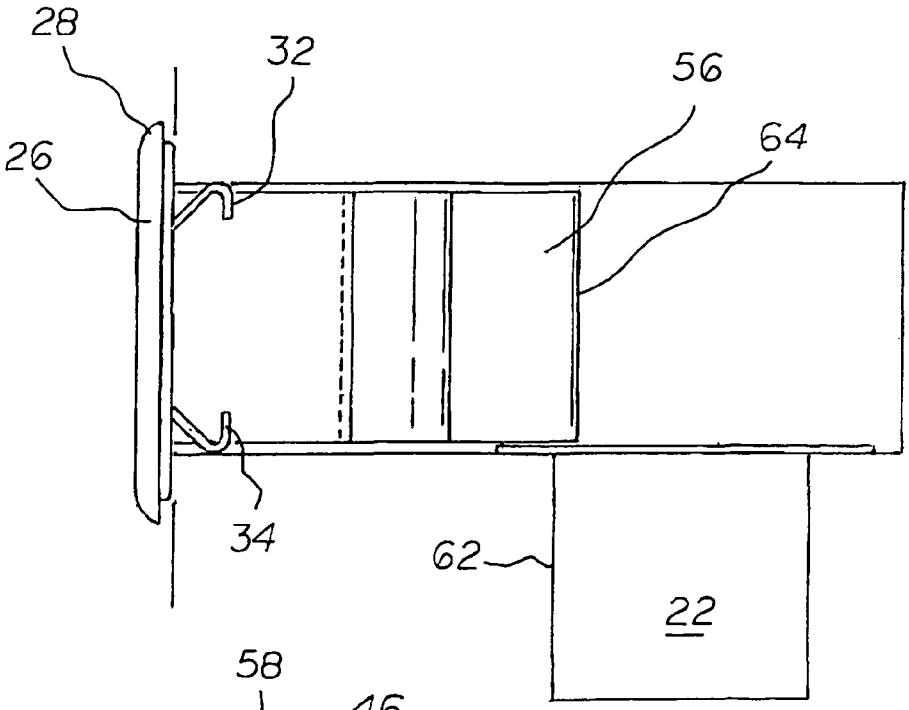
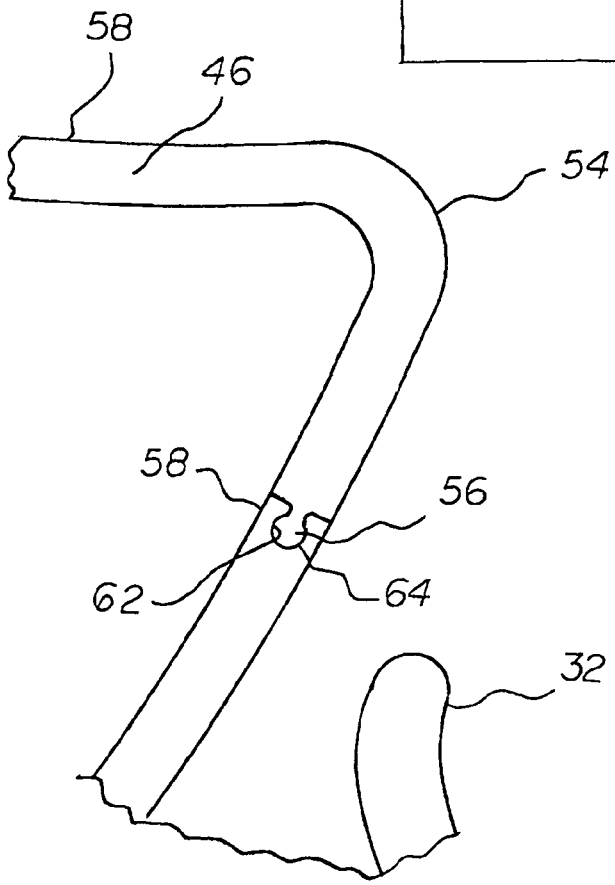
FIG 4

FIG 10
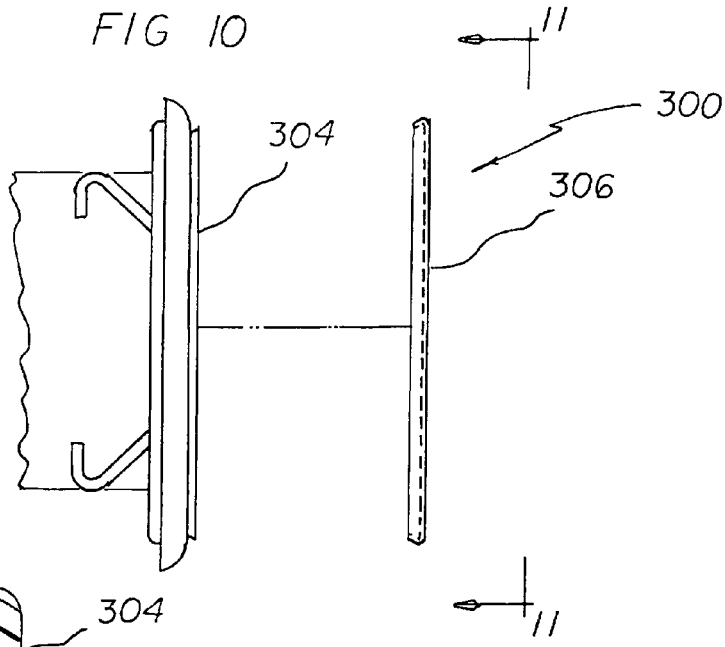
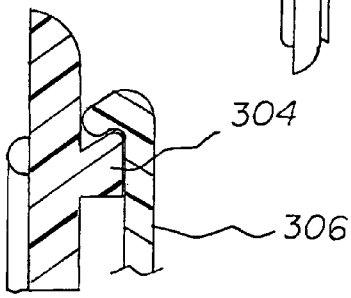
FIG 12
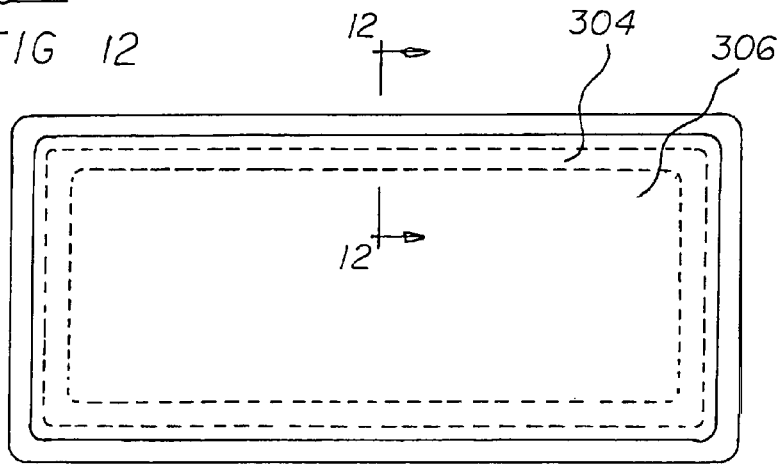
FIG 11

FIG 13
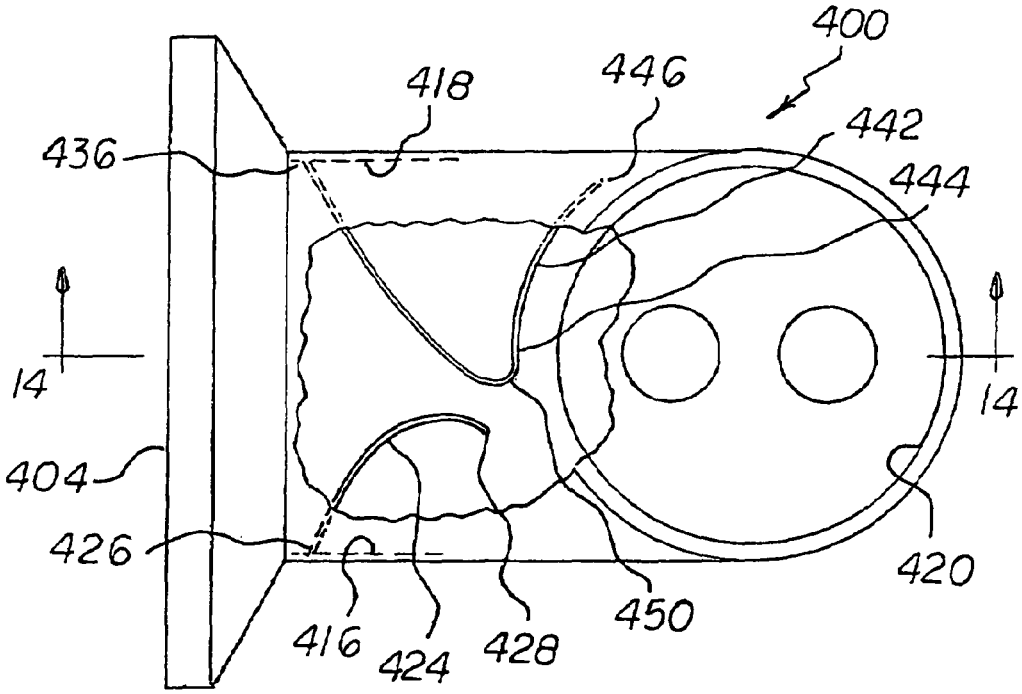
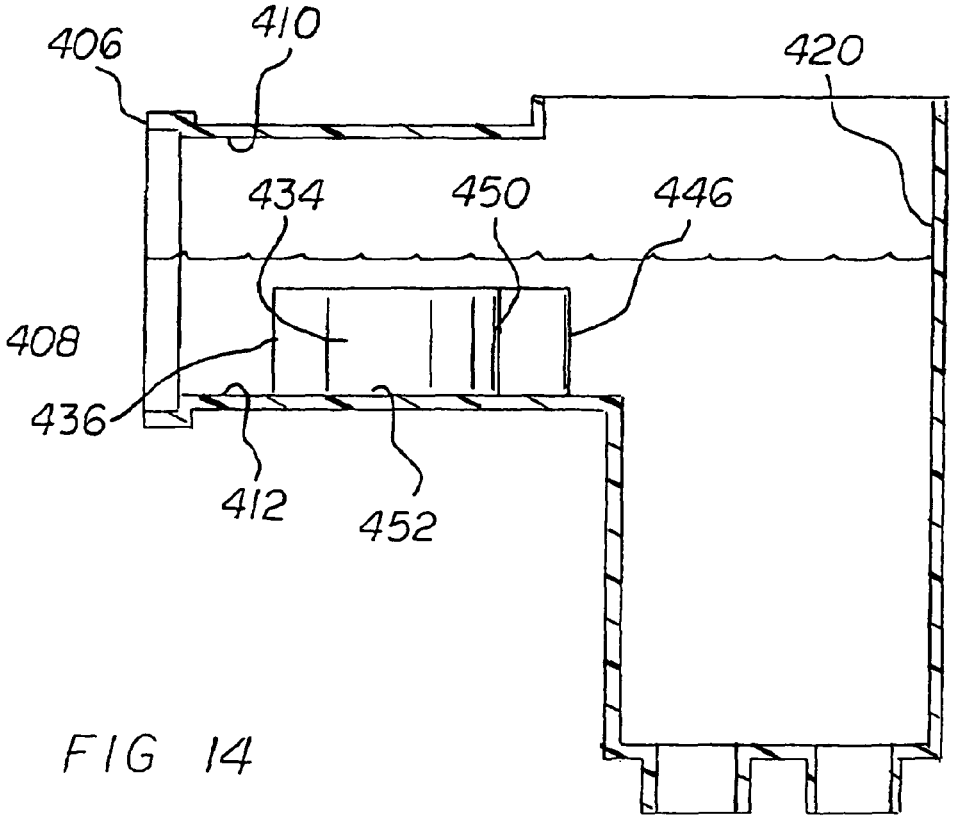
FIG 14

BUILT IN POOL SKIMMER ENHANCEMENT SYSTEM

RELATED APPLICATION

This application is a continuation-in-part of U.S. patent application Ser. No. 12/586,511, filed Sep. 23, 2009, now U.S. Pat. No. 8,202,416, the subject matter of which is incorporated herein by reference.

BACKGROUND OF THE INVENTION

The present invention relates to a built in pool skimmer enhancement system and more particularly pertains to increasing the speed of water flowing through a skimmer thereby maximizing the skimming effectiveness of the system, the skimming being done in a safe, convenient, simple and economical manner.

DESCRIPTION OF THE PRIOR ART

The use of built in pool skimmer systems of known designs and configurations is known in the prior art. More specifically, built in pool skimmer systems of known designs and configurations previously devised and utilized for the purpose of improving the effectiveness of skimming are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a built in pool skimmer enhancement system that allows for increasing the speed of water flowing through a skimmer thereby maximizing the skimming effectiveness of the system, the skimming being done in a safe, convenient, simple and economical manner.

In this respect, the built in pool skimmer enhancement system according to the present invention substantially departs from the conventional concepts and designs of the prior art, and in doing so provides an apparatus primarily developed for the purpose of increasing the speed of water flowing through a skimmer thereby maximizing the skimming effectiveness of the system, the skimming being done in a safe, convenient, simple and economical manner.

Therefore, it can be appreciated that there exists a continuing need for a new and improved built in pool skimmer enhancement system which can be used for increasing the speed of water flowing through a skimmer thereby maximizing the skimming effectiveness of the system, the skimming being done in a safe, convenient, simple and economical manner. In this regard, the present invention substantially fulfills this need.

SUMMARY OF THE INVENTION

In view of the foregoing disadvantages inherent in the known types of built in pool skimmer systems of known designs and configurations now present in the prior art, the present invention provides an improved built in pool skimmer enhancement system. As such, the general purpose of the present invention, which will be described subsequently in greater detail, is to provide a new and improved built in pool skimmer enhancement system and method which has all the advantages of the prior art and none of the disadvantages.

To attain this, the present invention essentially comprises a swimming pool having a side wall with a rectangular opening at water level for the passage of water from the pool for the skimming of water and the removal of debris from the skimmed water. The opening has parallel upper and lower horizontal surfaces and parallel first and second side vertical surfaces. The swimming pool has a chamber located interiorly of and at a common elevation with the opening. The chamber has a cylindrical well with a vertical axis for drawing a vortex of water from the pool into a pump and for filtering out debris.

Next, a first diverter plate is provided. The first diverter plate has an exterior edge adjacent to the first side surface in proximity to the opening. The first diverter plate also has an interior edge located between the opening and the well. The first diverter plate is arcuate with a vertical axis of rotation adjacent to the first side surface.

Next, a second diverter plate is provided. The second diverter plate has a primary section with an exterior edge adjacent to the second side surface in proximity to the opening. The primary section has an interior edge between the opening and the well. The primary section is arcuate with a vertical axis of rotation adjacent to the second side surface.

The second diverter plate also has a secondary section with an exterior edge located adjacent the interior edge of the primary section. The secondary section has an interior edge adjacent to the well. The secondary section has a vertical axis of rotation essentially co-extensive with the axis of the well. The interior edges of the first and second diverter plates are spaced a distance of between 5 and 15 percent of the distance between the first and second side surfaces. In this manner, a restriction is formed to increase water speed and skimming effectiveness.

The second diverter plate has an intermediate section coupling the primary and secondary sections of the second diverter plate. All of the diverter plates have lower edges secured to and extending upwardly from the lower surface of the opening. All of the plates have a height between 30 and 70 percent of the distance between the upper and lower surfaces of the opening.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved built in pool skimmer pool skimmer enhancement system which has all of the advantages of the prior art built in pool skimmer systems of known designs and configurations and none of the disadvantages.

It is another object of the present invention to provide a new and improved built in pool skimmer enhancement system which may be easily and efficiently manufactured and marketed.

It is further object of the present invention to provide a new and improved built in pool skimmer enhancement system which is of durable and reliable constructions.

An even further object of the present invention is to provide a new and improved built in pool skimmer enhancement system which is susceptible of a low cost of manufacture with regard to both materials and labor, and which accordingly is then susceptible of low prices of sale to the consuming public, thereby making such built in pool skimmer enhancement system economically available to the buying public.

Even still another object of the present invention is to provide a built in pool skimmer enhancement system for increasing the speed of water flowing through a skimmer thereby maximizing the skimming effectiveness of the system, the skimming being done in a safe, convenient, simple and economical manner.

Lastly, it is an object of the present invention to provide a new and improved built in pool skimmer enhancement system having a pool with an opening formed with upper and lower surfaces and first and second side surfaces and a chamber located interiorly of the opening having a cylindrical well with a vertical axis. A first diverter plate has an exterior edge adjacent to the first side surface and an interior edge between the opening and the well. The first diverter plate is arcuate with a vertical axis of rotation adjacent to the first side surface. A second diverter plate has primary and secondary sections. The primary section has an exterior edge adjacent to the second side surface and an interior edge between the opening and the well and is arcuate with a vertical axis of rotation adjacent to the second side surface. The secondary section is located adjacent the primary section with a vertical axis of rotation essentially co-extensive with the axis of the well. The diverter plates have closely spaced regions for redirecting the flow path for water to be skimmed to increase water speed, suction radius and skimming effectiveness.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a pool skimmer enhancement system constructed in accordance with the principles of the present invention.

FIG. 2 is a plan view of the system taken along line 2-2 of FIG. 1.

FIG. 3 is a side elevational view of the system taken along line 3-3 of FIG. 1.

FIG. 4 is an enlarged plan view of a portion of the system taken at circle 4 of FIG. 2.

FIG. 10 is a side elevational view of a portion of the system similar to FIG. 3 but with the portions separated prior to coupling and installation.

FIG. 11 is a front elevational view taken along line 11-11 of FIG. 10.

FIG. 12 is a cross sectional view taken along line 12-12 of FIG. 11.

FIG. 13 is a plan view similar to FIG. 2 but illustrating the preferred embodiment of the invention.

FIG. 14 is a cross sectional view taken along line 14-14 of FIG. 13.

The same reference numerals refer to the same parts throughout the various Figures.

DESCRIPTION OF THE PREFERRED EMBODIMENT

Figure 5:
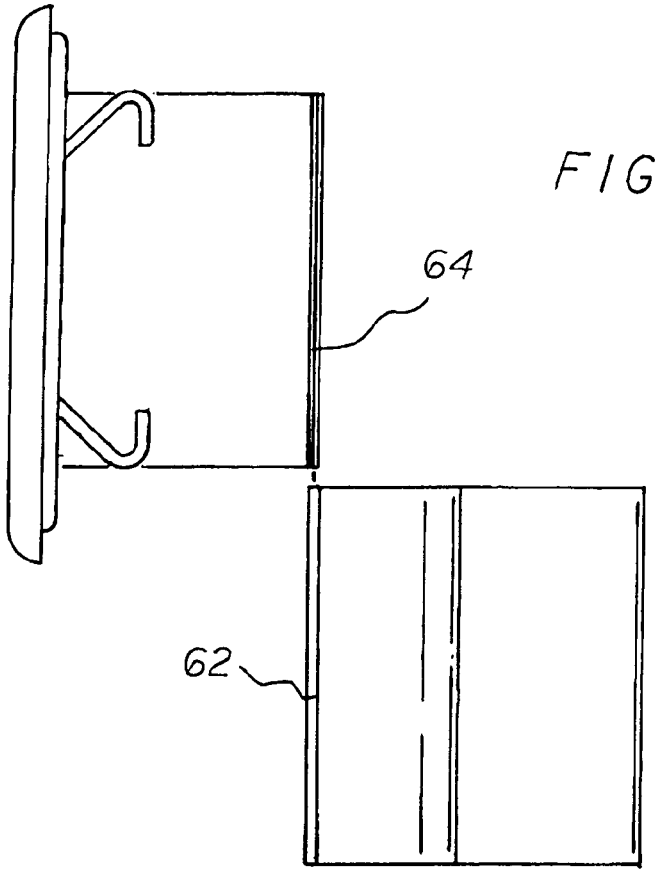
FIG. 5 is a side elevational view of a portion of the system similar to FIG. 3 but with the portions separated prior to coupling and installation.

With reference now to the drawings, and in particular to FIG. 1 thereof, the preferred embodiment of the new and improved pool skimmer enhancement system embodying the principles and concepts of the present invention and generally designated by the reference numeral 10 will be described.

The present invention, the pool skimmer enhancement system 10 is comprised of a plurality of components. Such components in their broadest context include a face plate and a long and short diverter plate. Such components are individually configured and correlated with respect to each other so as to attain the desired objective.

The pool skimmer enhancement system 10 of the present invention is for creating a stronger vortex of water, increasing the speed and suction of water coming into and flowing through a skimmer thereby maximizing the skimming radius and water circulating effectiveness of the system. The skimming is done in a safe, convenient, simple and economical manner. First provided is a swimming pool 14. The pool has a side wall 16 with a rectangular opening 18 at water level for the passage of water from the pool for the skimming of water and the removal of debris from the skimmed water. The opening, has parallel upper and lower horizontal edges and parallel first and second side vertical edges. The swimming pool has a chamber 20 located interiorly of and at a common elevation with the opening. The chamber has a cylindrical well 22 with a vertical axis for drawing a vortex of water from the pool into a pump and for filtering out debris.

Next provided is a face plate 26. The face plate has a rectangular periphery 28 with a size greater than the opening in the side wall. The face plate has a rectangular passageway 30 of a size less than the opening in the side wall. The passageway has parallel upper and lower horizontal edges and parallel first and second side vertical edges. The face plate has an exterior surface extending into the pool and an interior surface facing the side wall. The interior surface has two upper spring clamps 32 and two lower spring clamps 34. The spring clamps extend into the opening and contact the pool for the removable securement of the face plate to the pool.

Next, a first diverter plate 38 is provided. The first diverter plate has an exterior edge 40 attached to the first side edge of the face plate. The first diverter plate also has an interior edge 42 within the chamber midway between the opening and the well. The first diverter plate is arcuate with a vertical axis of rotation interiorly of the first side edge of the face plate.

Next, a second diverter plate 46 is provided. The second diverter plate has an exterior edge 48 attached to the second side edge of the face plate. The second diverter plate also has an interior edge 50 within the chamber midway between the opening and the well. The second diverter plate is arcuate with a vertical axis of rotation interiorly of the second side edge of the face plate. The interior edges of the first and second plate are spaced a distance of between 5 and 15 percent of the distance between the first and second side edges of the face plate for forming a restriction to increase water speed and skimming effectiveness.

Next, a third diverter plate 54 is provided. The third diverter plate is in a generally S-shaped configuration with a primary section 56 removably coupled to the interior edge of the second diverter plate. The third diverter plate has a secondary section 58 with a vertical axis of rotation co-extensive with the axis of the well. The diverter plates all have a height essentially equal to the distance between the upper and lower edges of the passageway through the face plate.

Lastly, coupling components are provided. The coupling components include a linear recess 62 along the interior edge of the second diverter plate and a linear projection 64 along the primary section of the third diverter plate. The recess and projection are adapted to be coupled during operation and use. The recess and projection are adapted to be separated for packaging, storage and transportation purposes.

Figure 6:
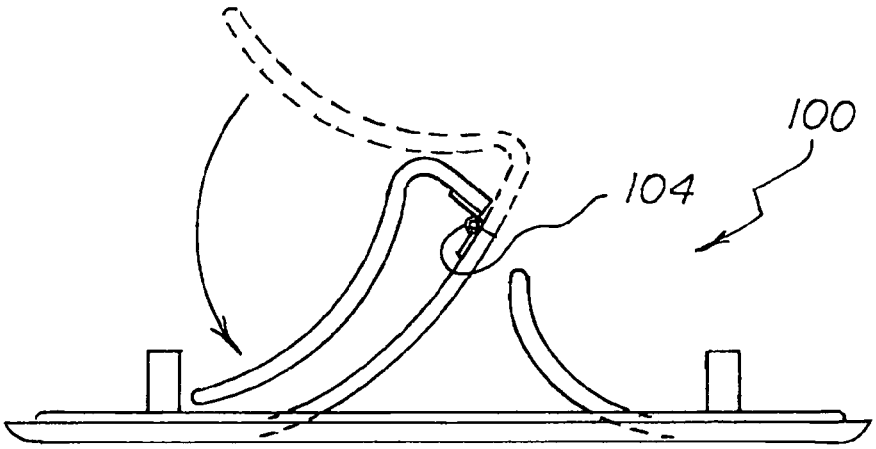
FIG. 6 is a plan view of a portion of the system similar to FIG. 2 but illustrating an alternate embodiment of the invention, portions of the system being folded prior to extending and installation.

An alternate embodiment of the system 100 is shown in FIG. 6. In this embodiment, the long diverter plate is formed of inner and outer sections. This embodiment further includes coupling components including a hinge 104 between the inner section and the outer section. The hinge is adapted to be folded out during operation and use. The hinge is also adapted to be folded in for packaging, storage and transportation purposes.

Figure 9:
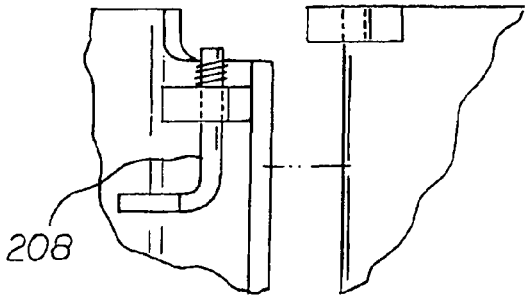
FIG. 9 is an enlarged side elevational view of a portion of the system taken at circle 9 of FIG. 8.
Figure 7:
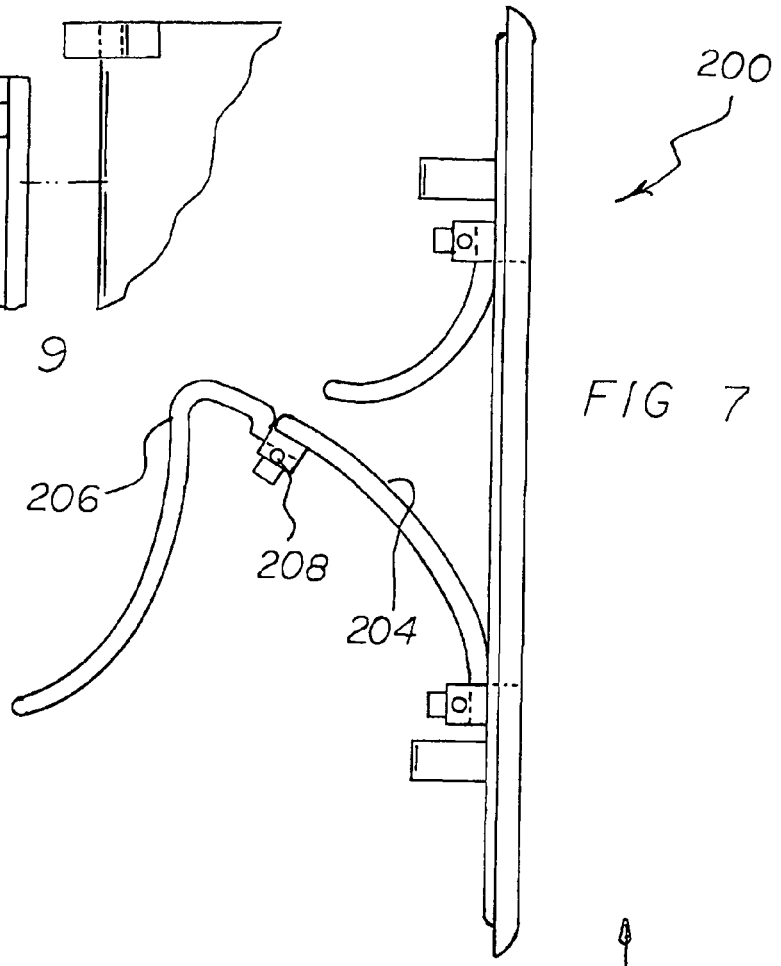
FIG. 7 is a plan view of a portion of the system similar to FIG. 2 but illustrating another alternate embodiment of the invention, portions of the system being folded prior to extending and installation.
Figure 8:
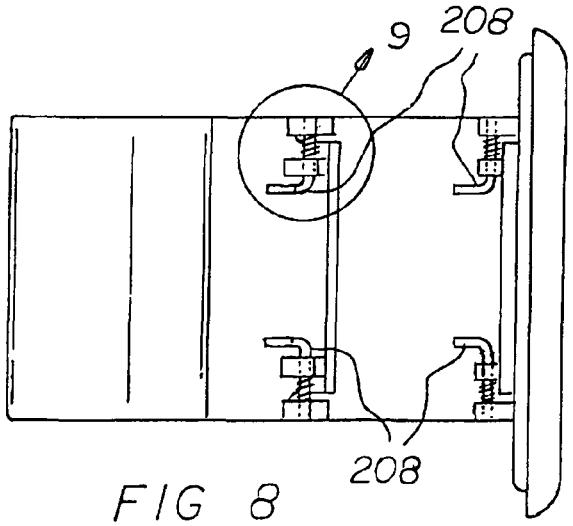
FIG. 8 is a side elevational view of the system taken along line 8-8 of FIG. 7.

An additional alternate embodiment of the system 200 is shown in FIGS. 7, 8 and 9. In this embodiment, the long diverter plate is formed of inner and outer sections 204, 206. This embodiment further includes coupling components. The coupling components include spring loaded fingers 208 between the inner section and the outer section. The fingers are adapted to be urged out during operation and use. The fingers are also adapted to be urged in for packaging, storage and transportation purposes. Spring loaded fingers are also located between the face plate and the diverter plates for further compacting of the system.

Another alternate embodiment of the system 300 is shown in FIGS. 10, 11 and 12. In this embodiment, the face plate has a peripheral flange 304. This embodiment further includes a cover 306 removably coupled to the flange.

The final alternate embodiment is a system 400 illustrated in FIGS. 13 and 14. As in the prior embodiments, the built in pool skimmer enhancement system of this embodiment is for increasing the speed of water flowing through a skimmer thereby maximizing the skimming effectiveness of the system. The skimming is done in a safe, convenient, simple and economical manner. First provided is a swimming pool 404. The pool has a side wall 406 with a rectangular opening 408 at water level for the passage of water from the pool for the skimming of water and the removal of debris from the skimmed water. The opening has parallel upper and lower horizontal surfaces 420, 422 and parallel first and second side vertical surfaces 424, 426. The swimming pool has a chamber 428 located interiorly of and at a common elevation with the opening. The chamber has a cylindrical well 430 with a vertical axis for drawing a vortex of water from the pool into a pump and for filtering out debris.

Next, a first diverter plate 424 is provided. The first diverter plate has an exterior edge 426 adjacent to the first side surface in proximity to the opening. The first diverter plate also has an interior edge 428 located between the opening and the well. The first diverter plate is arcuate with a vertical axis of rotation adjacent to the first side surface.

Next, a second diverter plate 432 is provided. The second diverter plate has a primary section 434 with an exterior edge 436 adjacent to the second side surface in proximity to the opening. The primary section has an interior edge 438 between the opening and the well. The primary section is arcuate with a vertical axis of rotation adjacent to the second side surface.

The second diverter plate also has a secondary section 442 with an exterior edge 444 located adjacent the interior edge of the primary section. The secondary section has an interior edge 446 adjacent to the well. The secondary section has a vertical axis of rotation essentially co-extensive with the axis of the well. The interior edges of the first and second diverter plates are spaced a distance of between 5 and 15 percent of the distance between the first and second side surfaces. In this manner, the water flow is redirected to increase water speed, suction, and skimming effectiveness.

The second diverter plate has an intermediate section 450 coupling the primary and secondary sections of the second diverter plate. All of the diverter plates have lower edges 452 secured to and extending upwardly from the lower surface of the opening. All of the plates have a height between 30 and 70 percent of the distance between the upper and lower surfaces of the opening.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A built in pool skimmer enhancement system comprising:

a pool having an opening formed with upper and lower surfaces and first and second side surfaces, the pool having a chamber located interiorly of the opening, the chamber having a cylindrical well with a vertical axis;

a first diverter plate with an exterior edge adjacent to the first side surface and with an interior edge between the opening and the well, the first diverter plate being arcuate with a vertical axis of rotation adjacent to the first side surface; and a second diverter plate having a primary section with an exterior edge adjacent to the second side surface and with an interior edge between the opening and the well, the primary section being arcuate with a vertical axis of rotation adjacent to the second side surface, the second diverter plate having a secondary section located adjacent the primary section with a vertical axis of rotation essentially co-extensive with the axis of the well, the diverter plates having closely spaced regions for redirecting the flow path for water to be skimmed to increase water speed, suction radius and skimming effectiveness.

2. The system as set forth in claim 1 and further including an intermediate section coupling the primary and secondary sections of the second diverter plate.

3. The system as set forth in claim 2 wherein all of the diverter plates are secured to and extending upwardly from the lower surface.

4. The system as set forth in claim 3 wherein all of the plates have a height between 30 and 70 percent of the distance between the upper and lower surfaces of the opening.

5. A built in pool skimmer enhancement system (400) for creating a stronger vortex of water, increasing the speed and suction of water coming into and flowing through a skimmer thereby maximizing the skimming radius and water circulating effectiveness of the system, the system comprising, in combination:

a swimming pool (404) having a side wall (406) with a rectangular opening (408) at water level for the passage of water from the pool for the skimming of water and the removal of debris from the skimmed water, the opening having parallel upper and lower horizontal surfaces (410, 412) and parallel first and second side vertical surfaces (414, 416), the pool having a chamber (418) located interiorly of and at a common elevation with the opening, the chamber having a cylindrical well (420) with a vertical axis for drawing a vortex of water from the pool into a pump and a filter for filtering out debris;

a first diverter plate (424), the first diverter plate having an exterior edge (426) adjacent to the first side surface in proximity to the opening, the first diverter plate having an interior edge (428) located between the opening and the well, the first diverter plate being arcuate with a vertical axis of rotation adjacent to the first side surface;

a second diverter plate (432) having a primary section (434) with an exterior edge (436) adjacent to the second side surface in proximity to the opening, the primary section having an interior edge (438) between the opening and the well, the primary section being arcuate with a vertical axis of rotation adjacent to the second side surface;

the second diverter plate having a secondary section (442) with an exterior edge (444) located adjacent the interior edge of the primary section, the secondary section having an interior edge (446) adjacent to the well, the secondary section having a vertical axis of rotation essentially co-extensive with the axis of the well, the interior edges of the first and second plate being spaced a distance of between 5 and 15 percent of the distance between the first and second side surfaces for redirecting the water flow to increase water speed, suction and skimming effectiveness;

the second diverter plate having an intermediate section (450) coupling the primary and secondary sections of the second diverter plate, all of the diverter plates having lower edges (452) secured to and extending upwardly from the lower surface, all of the plates have a height between 30 and 70 percent of the distance between the upper and lower surfaces.

* * * * *